US010612425B2

(12) United States Patent
Naganawa

(10) Patent No.: US 10,612,425 B2
(45) Date of Patent: Apr. 7, 2020

(54) ENGINE DEVICE

(71) Applicant: Yanmar Co., Ltd, Osaka-shi, Osaka-fu (JP)

(72) Inventor: Hiroaki Naganawa, Osaka (JP)

(73) Assignee: YANMAR CO., LTD., Osaka (JP)

( * ) Notice: Subject to any disclaimer, the term of this patent is extended or adjusted under 35 U.S.C. 154(b) by 0 days.

(21) Appl. No.: 16/312,114

(22) PCT Filed: Mar. 29, 2017

(86) PCT No.: PCT/JP2017/012977
§ 371 (c)(1),
(2) Date: Dec. 20, 2018

(87) PCT Pub. No.: WO2017/221503
PCT Pub. Date: Dec. 28, 2017

(65) Prior Publication Data

US 2019/0234245 A1 Aug. 1, 2019

(30) Foreign Application Priority Data

Jun. 23, 2016 (JP) ..... 2016-124654

(51) Int. Cl.
*F01L 1/14* (2006.01)
*F01M 13/04* (2006.01)
(Continued)

(52) U.S. Cl.
CPC ..... *F01L 1/146* (2013.01); *F01M 9/10* (2013.01); *F01M 9/104* (2013.01); *F01M 13/00* (2013.01);
(Continued)

(58) Field of Classification Search
CPC . F01L 2001/054; F01L 1/146; F01L 2810/02; F01M 9/101; F01M 9/104; F01M 13/00; F01M 13/04; F01M 2013/0461
(Continued)

(56) References Cited

U.S. PATENT DOCUMENTS 1,595,434 A * 8/1926 Vincent ..... F01L 1/14 123/90.34
1,604,412 A * 10/1926 Horning ..... F02F 7/0046 123/58.1
(Continued)

FOREIGN PATENT DOCUMENTS

DE 19549188 A1 11/1996
EP 1471218 A1 10/2004
(Continued)

OTHER PUBLICATIONS

Extended European Search Report dated May 28, 2019 for EP Application No. 17814975, citing the art herein.
(Continued)

*Primary Examiner* — Jorge L Leon, Jr.
(74) *Attorney, Agent, or Firm* — Norton Rose Fulbright US LLP

(57) ABSTRACT

An engine device including, in a cylinder block thereof, a cylinder bore, a cam chamber accommodating a camshaft, a push-rod chamber accommodating a push-rod, and a tappet holder configured to hold a tappet in a slidable manner, the tappet being configured to transmit the drive force from the camshaft to the push-rod. The tappet holder partitions the cam chamber and the push-rod chamber. A bypass passage communicating the cam chamber with the push-rod chamber is formed between the tappet holder and the cylinder bore.

3 Claims, 16 Drawing Sheets

(51) Int. Cl.
*F01M 9/10* (2006.01)
*F01M 13/00* (2006.01)
*F01L 1/047* (2006.01)

(52) U.S. Cl.
CPC ..... *F01M 13/04* (2013.01); *F01L 2001/054* (2013.01); *F01L 2810/02* (2013.01); *F01M 2013/0488* (2013.01)

(58) Field of Classification Search
USPC ..... 123/90.34, 90.37, 90.38, 90.48, 90.61
See application file for complete search history.

(56) References Cited

U.S. PATENT DOCUMENTS

| | | | | | |
|---|---|---|---|---|---|
| 1,748,703 | A * | 2/1930 | Calkins | F01L 1/14 | 123/90.49 |
| 3,273,546 | A * | 9/1966 | Von Arx | F01L 1/12 | 123/90.39 |
| 4,601,267 | A | 7/1986 | Kronich | | |
| 5,579,735 | A * | 12/1996 | Todero | F01M 3/04 | 123/317 |
| 5,957,118 | A * | 9/1999 | Tateno | F01M 13/04 | 123/573 |
| 2005/0011503 | A1 | 1/2005 | Deane | | |

FOREIGN PATENT DOCUMENTS

| | | | |
|---|---|---|---|
| JP | 48-001065 | Y1 | 1/1973 |
| JP | 1980-036974 | U | 3/1980 |
| JP | S60-77714 | U | 5/1985 |
| JP | 63-039368 | Y2 | 10/1988 |
| JP | 1989-019012 | U | 1/1989 |
| JP | H05-077523 | A | 3/1993 |
| JP | 1993-092408 | U | 12/1993 |
| JP | 6-027496 | B2 | 4/1994 |
| JP | H09-032530 | A | 2/1997 |
| JP | 2009-002219 | A | 1/2009 |

OTHER PUBLICATIONS

International Search Report dated Jun. 13, 2017 issued in corresponding PCT Application PCT/JP2017/012977 cites the patent documents above.

* cited by examiner

ENGINE DEVICE

CROSS REFERENCES TO RELATED APPLICATIONS

This application is a national stage application pursuant to 35 U.S.C. 371 of International Application No. PCT/JP2017/012977, filed on Mar. 29, 2017, which claims priority under 35 U.S.C. § 119 to Japanese Patent Application No. 2016-124654, filed on Jun. 23, 2016, the disclosures of which are hereby incorporated by reference in their entireties.

TECHNICAL FIELD

The present invention relates to an engine device.

BACKGROUND ART

An OHV engine device having in a cylinder block thereof, a cam chamber accommodating a camshaft and a push-rod chamber accommodating a push-rod is well known (e.g. see Patent Literatures 1 and 2; hereinafter, PTLs 1 and 2). In such an engine device, a drive force of the camshaft is transmitted to the push-rod through a tappet held in a slidable manner. Further, the cam chamber and the push-rod chamber are used as a blow-by gas path through which blow-by gas moves from the inside of a crank case to the inside of a head cover.

CITATION LIST

Patent Literature

PTL 1: Japanese Patent Application Laid-Open No. H05-77523 (1993)

PTL 2: Japanese Patent Application Laid-Open No. H09-32530 (1997)

SUMMARY OF INVENTION

Technical Problem

If the push-rod chamber and the cam chamber are directly communicated with each other relative to up-down directions, lubricant scooped up in the crank case turns into a mist-like form and flows out with the blow-by gas, directly to the side of the cylinder head through the cam chamber and the push-rod chamber. This leads to a problem of an increase in the consumption of the lubricant.

In view of the problem, an object of the present invention is to reduce an amount of lubricant flowing out from the side of the crank case to the side of the cylinder head through a cam chamber and a push-rod chamber.

Solution to Problem

An engine device according to an aspect of the present invention is an engine device including in a cylinder block thereof, a cylinder bore, a cam chamber accommodating a camshaft, a push-rod chamber accommodating a push-rod, and a tappet holder configured to hold a tappet in a slidable manner, the tappet being configured to transmit a drive force from the camshaft to the push-rod. The tappet holder partitions the cam chamber and the push-rod chamber. A bypass passage communicating the cam chamber with the push-rod chamber is formed between the tappet holder and the cylinder bore.

The engine device of the above aspect of the present invention may be such that, for example, at least a part of a cylinder bore side inner wall of the cam chamber, in a lower portion of the bypass passage, is recessed closer to the cylinder bore than the bypass passage, the camshaft is configured so that the outer circumferential surface of the camshaft rotates in a direction from the side of the tappet holder to the side of the crank case, when viewed from the side of the cylinder bore.

Further, the engine device of the above aspect of the present invention may be such that the bypass passage is in communication with the push-rod chamber at a position close to one of inner walls of the push-rod chamber, relative to an axial direction along a rotational axis of the camshaft, the inner walls intersecting the axial direction, another inner wall out of the inner walls of the push-rod chamber is recessed towards outside of an outline of a communication hole in the push-rod chamber, the communication hole being provided in a joint surface of the cylinder block with a cylinder head.

Further, the engine device of the above aspect of the present invention may be such that the camshaft includes a plurality of sets of an intake cam and an exhaust cam, the cam chamber is partitioned into a plurality of cam chamber segments for each set of the intake cam and the exhaust cam, and the bypass passage is in communication with each of the cam chamber segments at a position offset from the center of the cam chamber segment in an axial direction along a rotational axis of the camshaft.

Advantageous Effects of Invention

In the engine device of the above aspect of the present invention, the tappet holder holding, in a slidable manner, the tappet for transmitting the drive force of the camshaft to the push-rod partitions the cam chamber and the push-rod chamber from each other, and the bypass passage communicating the cam chamber with the push-rod chamber is formed between the tappet holder and the cylinder bore. This forms a blow-by gas path bent to bypass the tappet holder. The engine device of the present invention induces adhesion of lubricant to the wall surface or bonding of droplets of lubricant in the mist-form by having the blow-by gas collide with a wall surface within the bent blow-by gas path. Therefore, a captured amount of lubricant in the blow-by gas can be increased, and the amount of lubricant flowing out from the crank case to the side of the cylinder head through the cam chamber and the push-rod chamber can be reduced.

In the engine device of the above aspect of the present invention, at least a part of a cylinder bore side inner wall of the cam chamber, in a lower portion of the bypass passage, is recessed closer to the cylinder bore than the bypass passage. With the recessed portion of the cylinder bore side inner wall of the cam chamber, the lubricant captured in the push-rod chamber or the bypass passage is kept from being taken out again by the blow-by gas, when the captured lubricant flows on an inner wall surface of the bypass passage down to the cylinder bore side inner wall of the cam chamber. Therefore, the amount of lubricant flowing out to the side of the cylinder head can be further reduced.

In the engine device of the above aspect of the present invention, the camshaft is configured so that an outer circumferential surface of the camshaft rotates in a direction from the side of the tappet holder to the side of the crank case, when viewed from the side of the cylinder bore. The splashes of the lubricant scattered from the camshaft surface due to the rotation of the camshaft hardly enter the bypass passage and do not flow toward the side of the cylinder head in the bypass passage. Therefore, the splashes of the lubricant are kept from moving towards the side of the cylinder head, and the amount of the lubricant flowing out to the side of the cylinder head can be further reduced.

In the engine device of the above aspect of the present invention, the bypass passage is in communication with the push-rod chamber at a position close to one of inner walls of the push-rod chamber, the inner walls intersecting an axial direction along a rotational axis of the camshaft. This makes the blow-by gas path more complicated, and forms a flow of the blow-by gas in a lateral direction within the push-rod chamber. Therefore, a larger amount of blow-by gas can collide with the wall surface in the blow-by gas path, and an amount of lubricant flowing out to the side of the cylinder head can be further reduced.

Further, in the engine device of the above aspect of the present invention, another inner wall out of the inner walls of the push-rod chamber intersecting the axial direction is recessed towards outside of an outline of a communication hole in the push-rod chamber, the communication hole being provided in a joint surface of the cylinder block with a cylinder head. This way, a part of the flow of the blow-by gas in the push-rod chamber can flow nearby a portion recessed towards outside of the communication hole. Therefore, the blow-by gas path becomes more complicated, and the amount of the lubricant flowing out to the side of the cylinder head can be further reduced.

Further, in the engine device of the above aspect of the present invention, the camshaft includes a plurality of sets of an intake cam and an exhaust cam, the cam chamber is partitioned into a plurality of cam chamber segments for each set of the intake cam and the exhaust cam, and the bypass passage is in communication with each of the cam chamber segments at a position offset from the center of the cam chamber segment in an axial direction along a rotational axis of the camshaft. This way, the flow of the blow-by gas in each cam chamber segment can be biased so as to let the blow-by gas collide with an inner wall of the cam chamber segment. Therefore, an amount of lubricant captured from the blow-by gas in the cam chamber segment can be increased and the amount of lubricant flowing out to the side of the cylinder head can be further reduced.

BRIEF DESCRIPTION OF DRAWINGS

FIG. 13A and FIG. 13B Diagrams showing the cylinder block, wherein FIG. 13A is a schematic plan view thereof and FIG. 13B is a schematic cross-sectional view thereof taken along the line 13B-13B in FIG. 10.

FIG. 14A and FIG. 14B Diagrams showing the cylinder block, wherein FIG. 14A is a schematic cross-sectional view thereof taken along, the line 14A-14A in FIG. 10 and FIG. 14B is a schematic cross-sectional view thereof taken along the line 14B-14B in FIG. 10.

DESCRIPTION OF EMBODIMENTS

Figure 1:
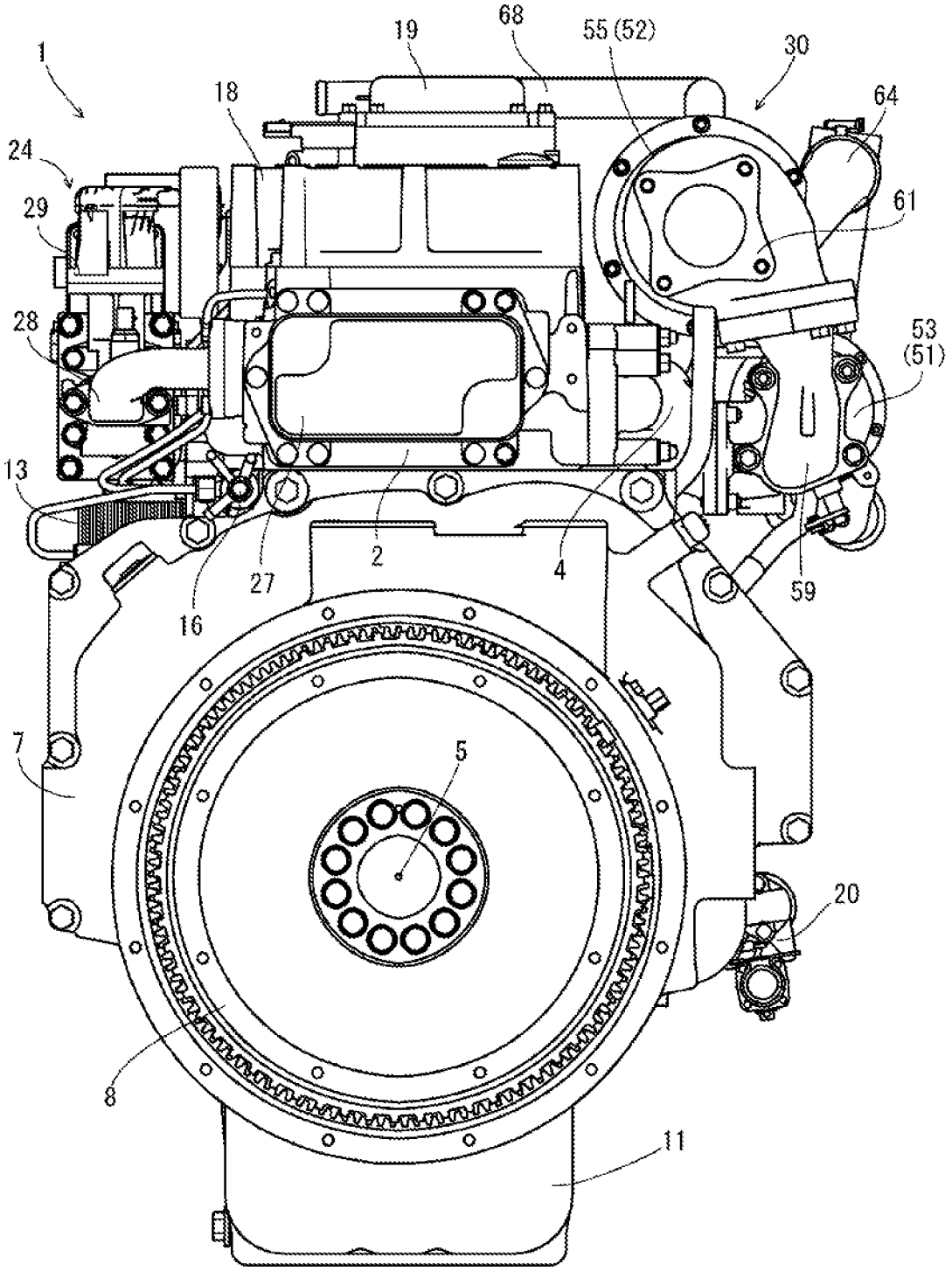
FIG. 1 A schematic front view of an engine.
Figure 2:
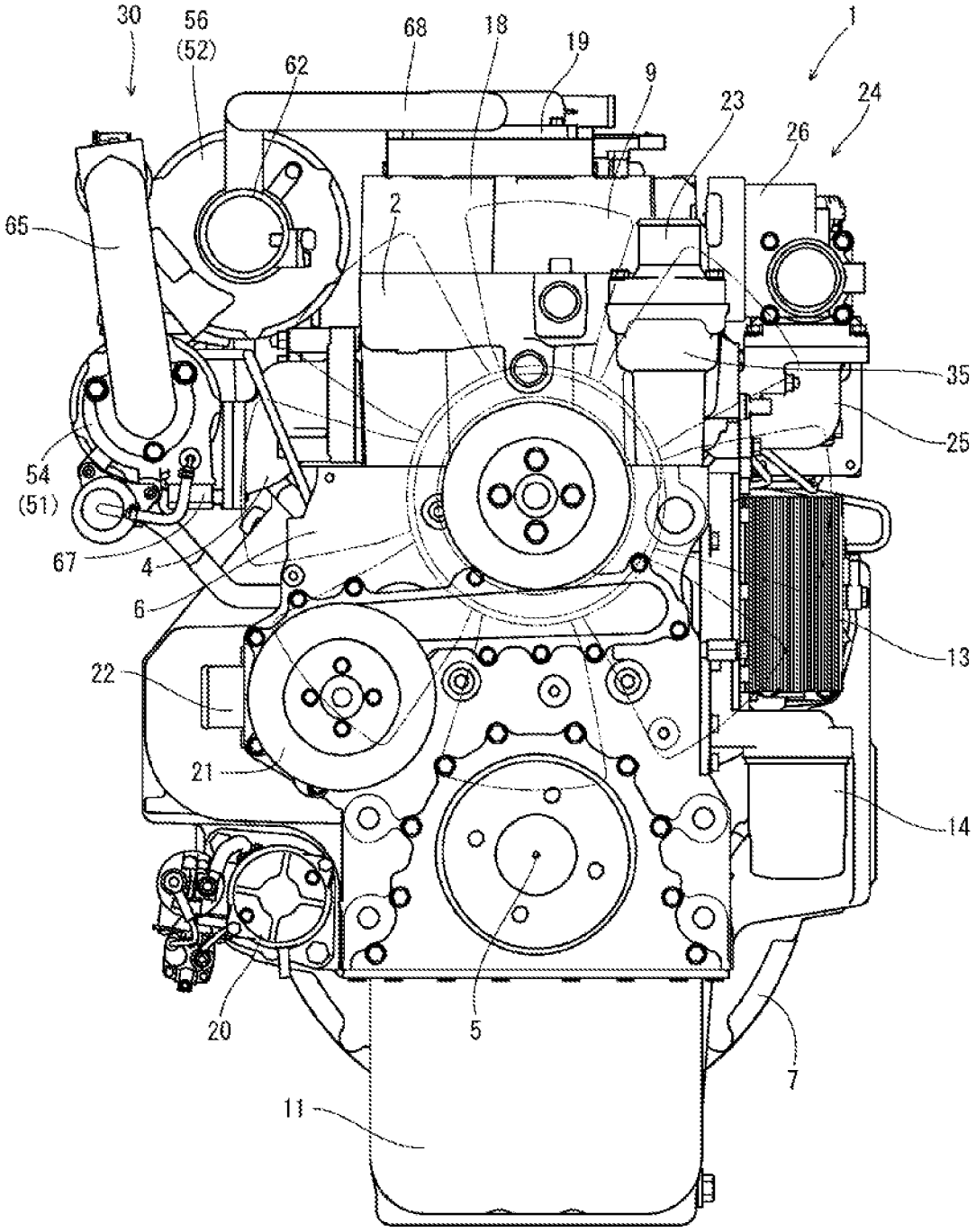
FIG. 2 A schematic rear view of the engine.
Figure 3:
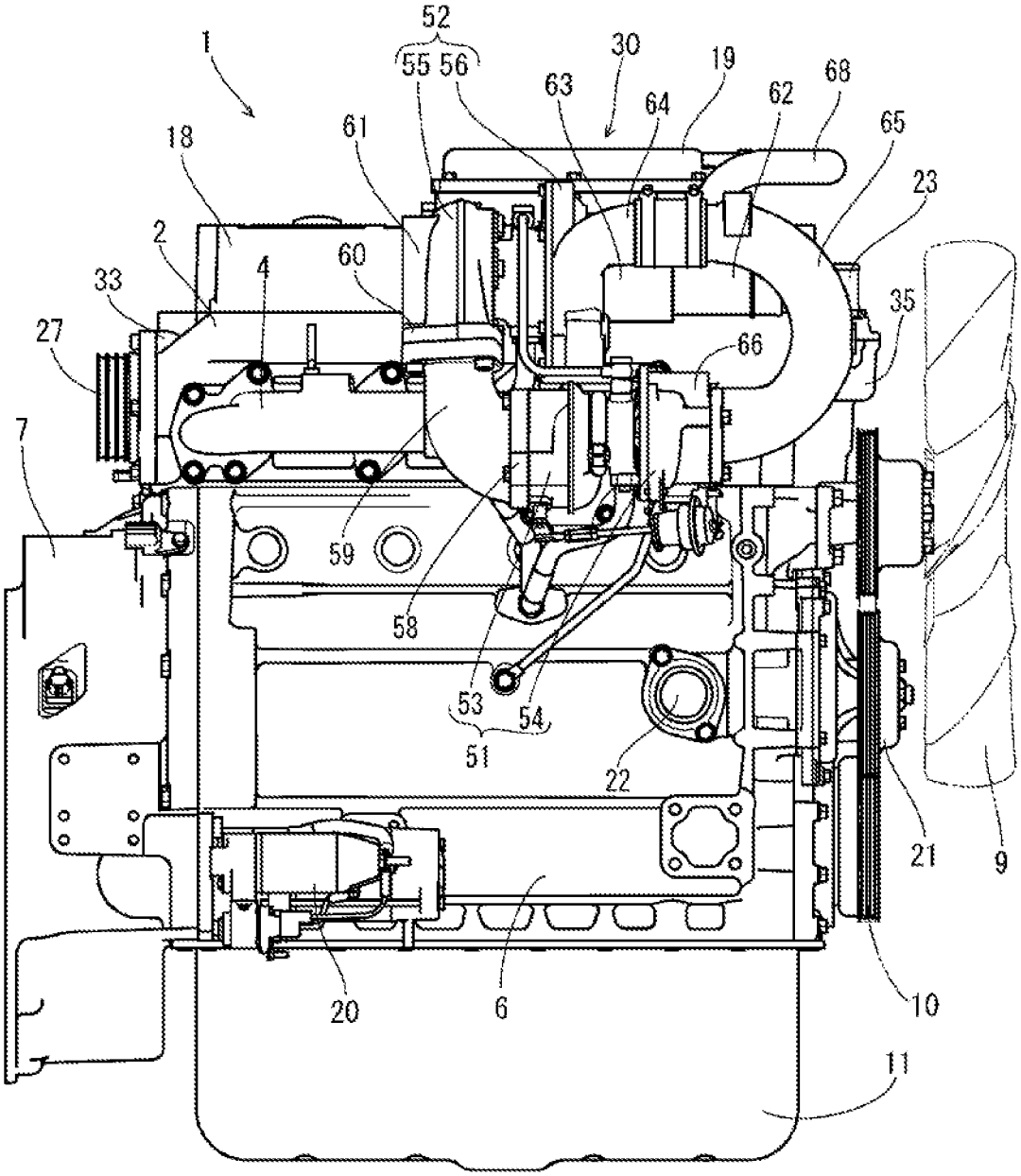
FIG. 3 A schematic left side view of the engine.
Figure 4:
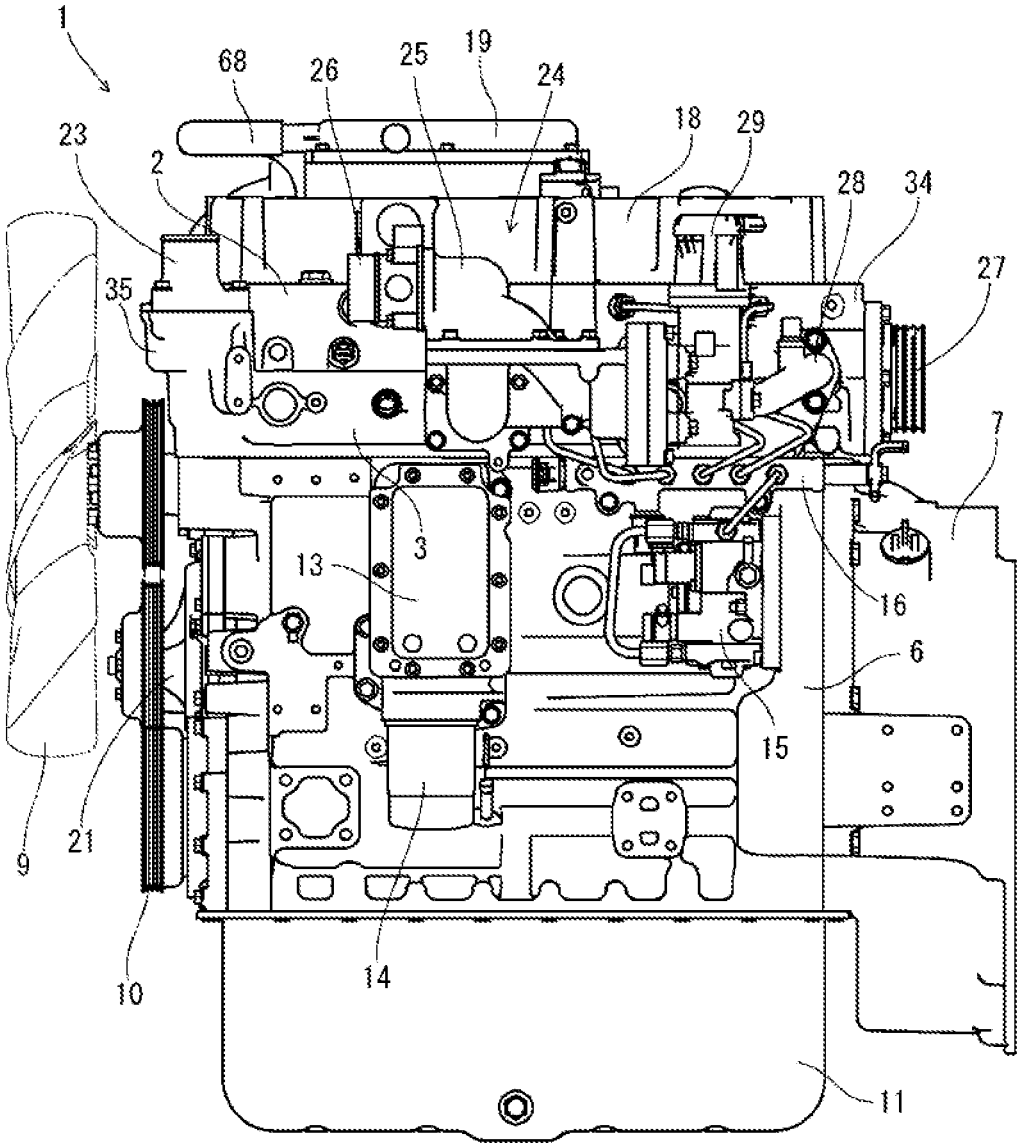
FIG. 4 A schematic right side view of the engine.
Figure 5:
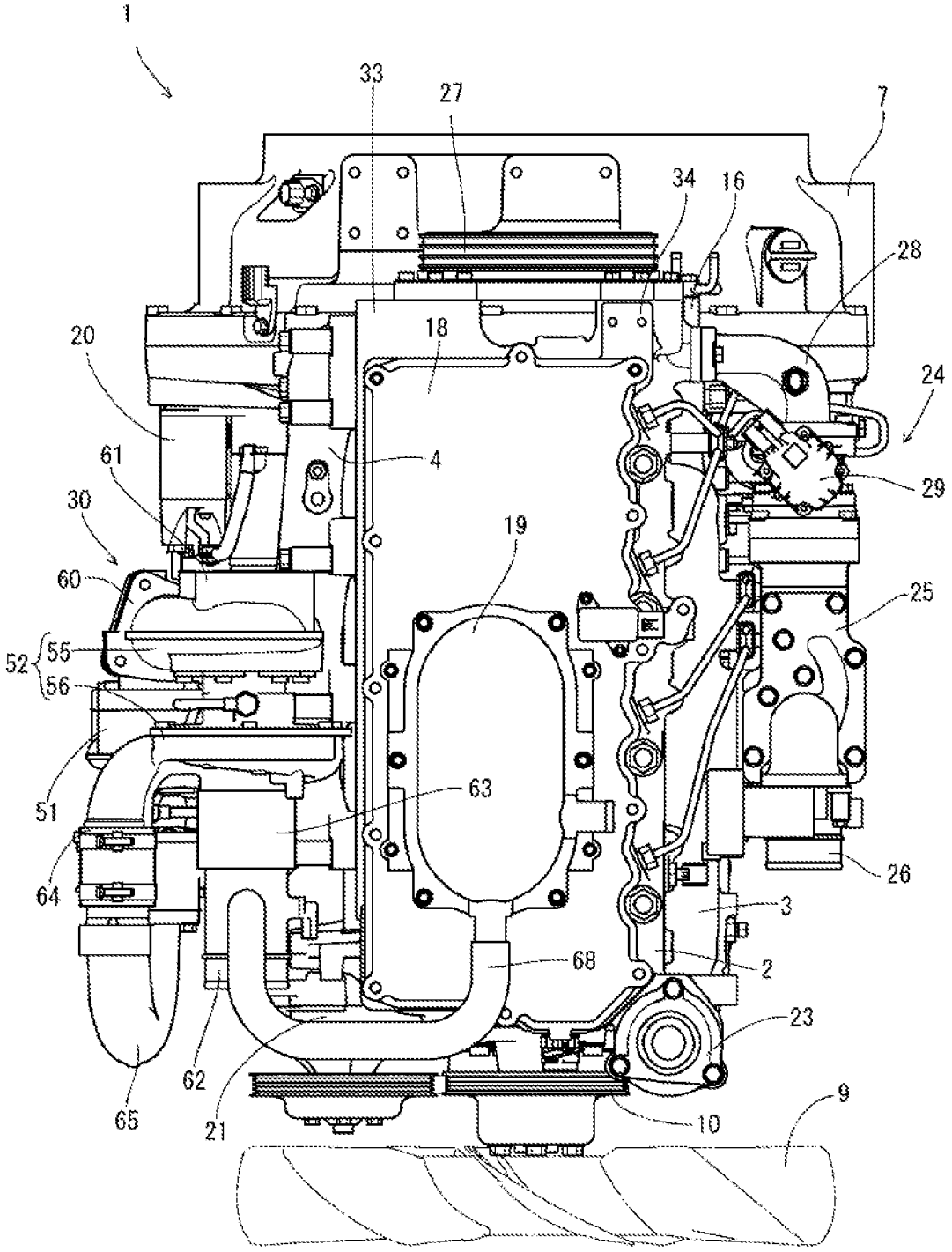
FIG. 5 A schematic plan view of the engine.
Figure 6:
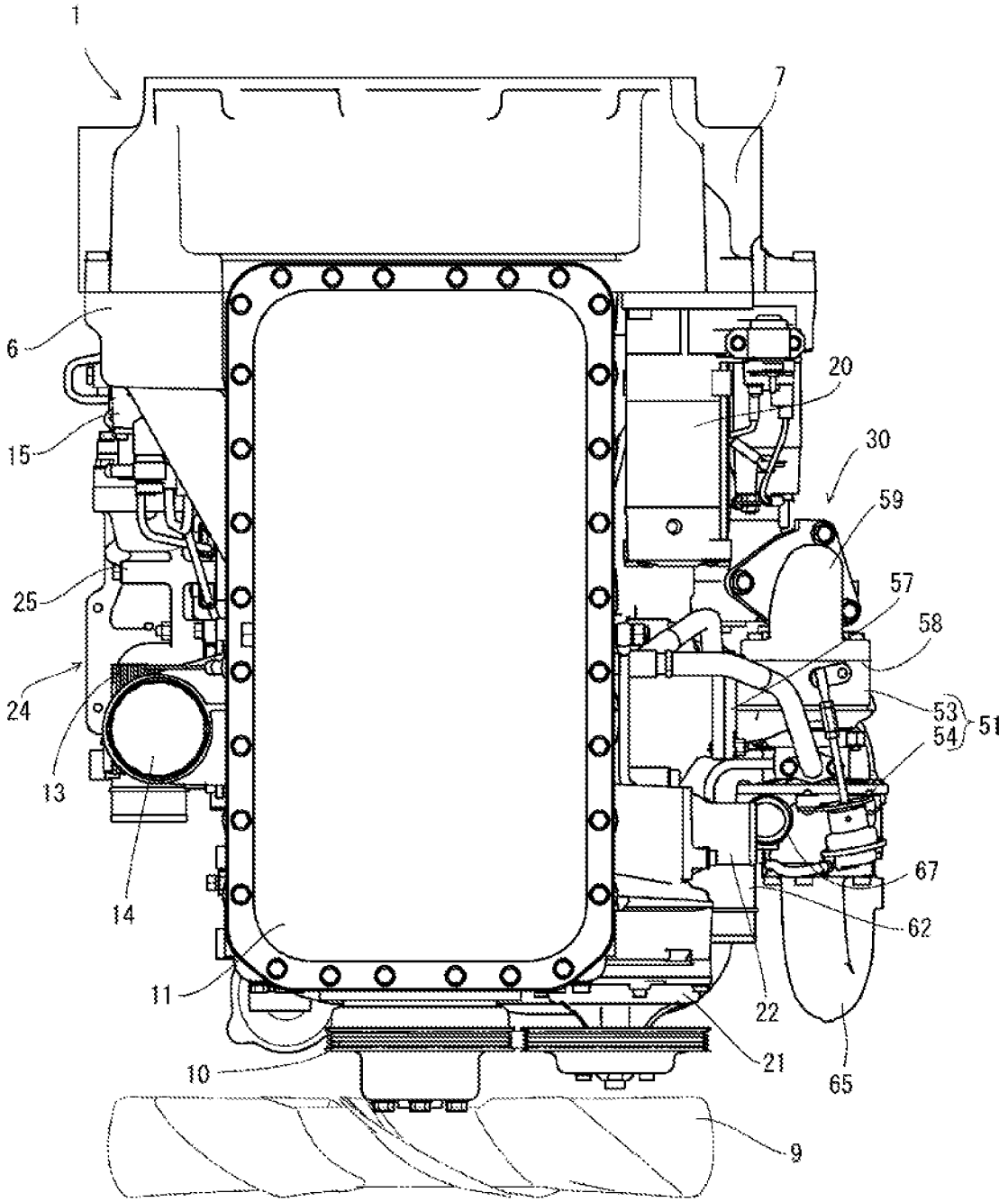
FIG. 6 A schematic bottom view of the engine.
Figure 7:
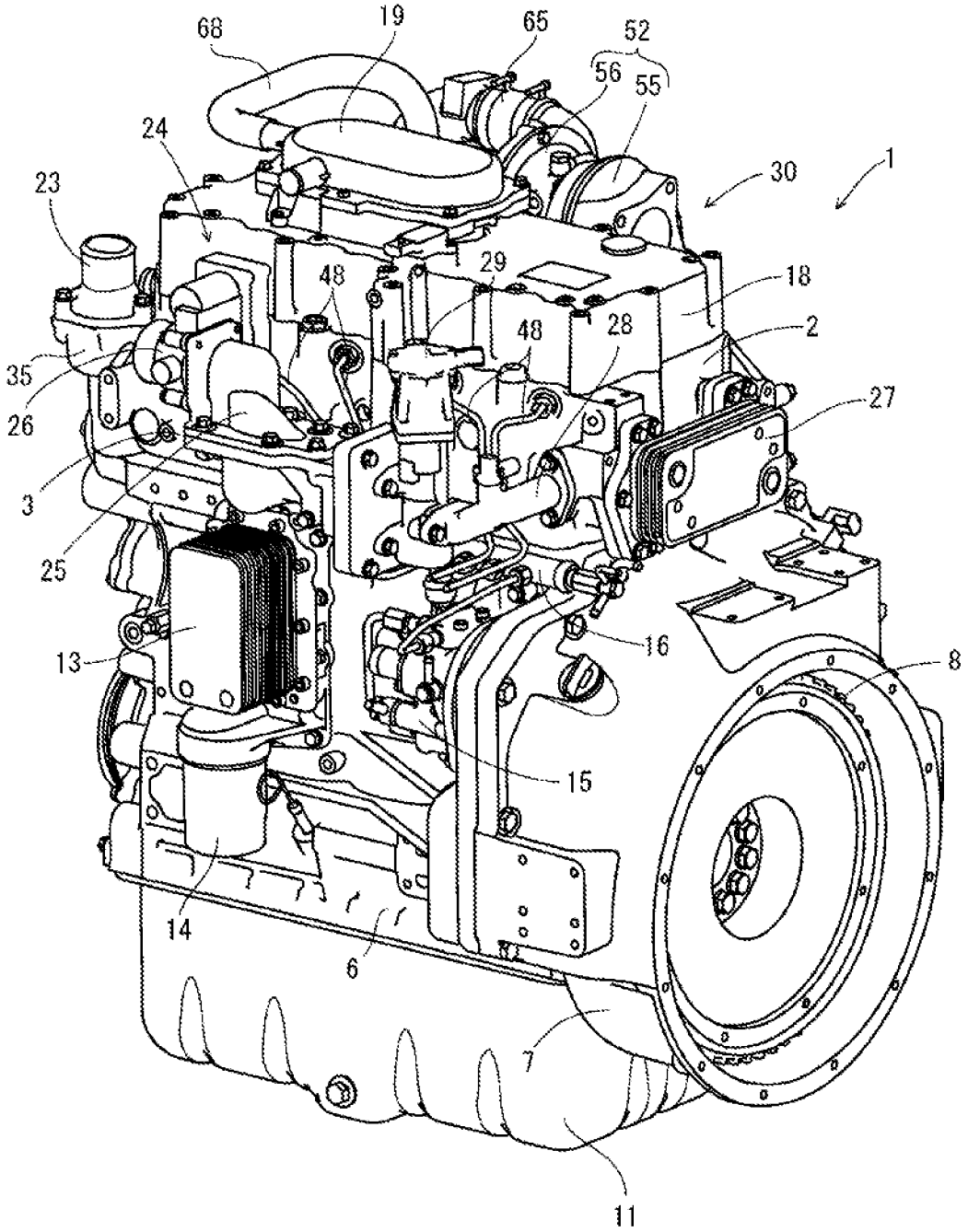
FIG. 7 A schematic perspective view of the engine as viewed from diagonally front.
Figure 8:
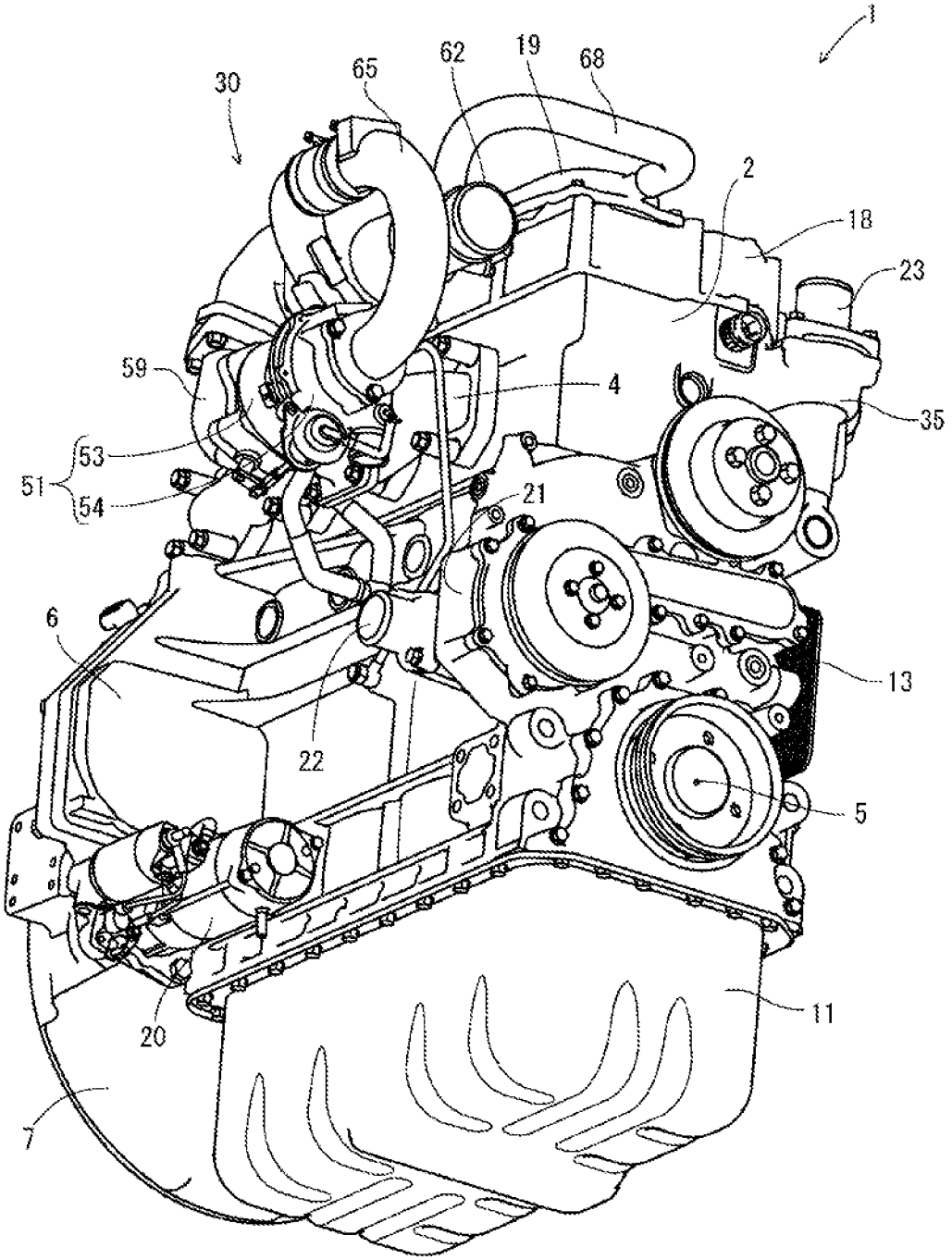
FIG. 8 A schematic perspective view of the engine as viewed from diagonally rear.

In the following, an embodiment of the present invention will be described with reference to the drawings. First, referring to FIG. 1 to FIG. 8, an overall structure of a diesel engine which is a diesel engine (engine device) 1 will be described. In the descriptions below, opposite side portions parallel to a crankshaft 5 (side portions on opposite sides relative to the crankshaft 5) will be defined as left and right, a side where a flywheel housing 7 is disposed will be defined as front, and a side where a cooling fan 9 is disposed will be defined as rear. For convenience, these are used as a benchmark for a positional relationship of left, right, front, rear, up, and down in the engine 1.

As shown in FIG. 1 to FIG. 8, an intake manifold 3 and an exhaust manifold 4 are disposed in one side portion and the other side portion of the engine 1 parallel to the crankshaft 5. In the embodiment, the intake manifold 3 provided on a right surface of a cylinder head 2 is formed integrally with the cylinder head 2. The exhaust manifold 4 is provided on a left surface of the cylinder head 2. The cylinder head 2 is mounted on a cylinder block 6 in which the crankshaft 5 and a piston 72 (see FIG. 10) are disposed. The cylinder block 6 pivotally supports the crankshaft 5 such that the crankshaft 5 is rotatable.

The crankshaft 5 has its front and rear distal ends protruding from front and rear surfaces of the cylinder block 6. The flywheel housing 7 is fixed to one side portion of the engine 1 (in the embodiment, a front surface side of the cylinder block 6) intersecting the crankshaft 5. A flywheel 8 is disposed in the flywheel housing 7. The flywheel 8, which is pivotally supported on the front end side of the crankshaft 5, is configured to rotate integrally with the crankshaft 5. The flywheel 8 is configured such that power of the engine 1 is extracted to an actuating part of a work machine (for example, a hydraulic shovel, a forklift, or the like) through the flywheel 8. The cooling fan 9 is disposed in the other side portion of the engine 1 (in the embodiment, a rear surface side of the cylinder block 6) intersecting the crankshaft 5. A rotational force is transmitted from the rear end side of the crankshaft 5 to the cooling fan 9 through a V-belt 10.

An oil pan 11 is disposed on a lower surface of the cylinder block 6. A lubricant is stored in the oil pan 11. The lubricant in the oil pan 11 is suctioned by an oil pump (not shown) disposed on the right surface side of the cylinder block 6, the oil pump being arranged in a coupling portion where the cylinder block 6 is coupled to the flywheel housing 7. The lubricant is then supplied to lubrication parts of the engine 1 through an oil cooler 13 and an oil filter 14 that are disposed on the right surface of the cylinder block 6. The lubricant supplied to the lubrication parts is then returned to the oil pan 11. The oil pump is configured to be driven by rotation of the crankshaft 5.

In the coupling portion where the cylinder block 6 is coupled to the flywheel housing 7, a fuel feed pump 15 for feeding a fuel is attached. The fuel feed pump 15 is disposed below an EGR device 24. A common rail 16 is fixed to a side surface of the cylinder block 6 at a location below the intake manifold 3 of the cylinder head 2. The common rail 16 is disposed above the fuel feed pump 15. Injectors 17 (see FIG. 9) for four cylinders are provided on an upper surface of the cylinder head 2 which is covered with a head cover 18. Each of the injectors has a fuel injection valve of electromagnetic-controlled type.

Each of the injectors 17 is connected to a fuel tank (not shown) through the fuel feed pump 15 and the common rail 16 having a cylindrical shape. The fuel tank is mounted in a work vehicle. A fuel in the fuel tank is pressure-fed from the fuel feed pump 15 to the common rail 16, so that a high-pressure fuel is stored in the common rail 16. By controlling the opening/closing of the fuel injection valves (not shown) of the injectors 17, the high-pressure fuel in the common rail 16 is injected from the injectors 17 to the respective cylinders of the diesel engine 1.

A blow-by gas recirculation device 19 is provided on an upper surface of the head cover 18 covering intake valves 36 and exhaust valves 37 (see FIG. 9), and the like disposed on the upper surface of the cylinder head 2. The blow-by gas recirculation device 19 takes in a blow-by gas that has leaked out of a combustion chamber of the engine 1 or the like toward the upper surface of the cylinder head 2. A blow-by gas outlet of the blow-by gas recirculation device 19 is in communication with an intake part of a two-stage turbocharger 30 through a recirculation hose 68. A blow-by gas, from which a lubricant component is removed in the blow-by gas recirculation device 19, is then recirculated to the intake manifold 3 via the two-stage turbocharger 30.

An engine starting starter 20 is attached to the flywheel housing 7. The starter 20 is disposed below the exhaust manifold 4. A position where the starter 20 is attached to the flywheel housing 7 is below a coupling portion where the cylinder block 6 is coupled to the flywheel housing 7.

A coolant pump 21 for circulating a coolant is provided in a portion of the rear surface of the cylinder block 6, the portion being a little left-hand. Rotation of the crankshaft 5 causes the coolant pump 21 as well as the cooling fan 9 to be driven through the cooling fan driving V-belt 10. Driving the coolant pump 21 causes a coolant in a radiator (not shown) mounted in the work vehicle to be supplied to the coolant pump 21. The coolant is then supplied to the cylinder head 2 and the cylinder block 6, to cool the engine 1.

A coolant inlet pipe 22 disposed below the exhaust manifold 4 is provided on the left surface of the cylinder block 6 and is fixed at a height equal to the height of the coolant pump 21. The coolant inlet pipe 22 is in communication with a coolant outlet of the radiator. A coolant outlet pipe 23 that is in communication with a coolant inlet of the radiator is fixed to a rear portion of the cylinder head 2. The cylinder head 2 has a coolant drainage 35 that protrudes rearward from the intake manifold 3. The coolant outlet pipe 23 is provided on an upper surface of the coolant drainage 35.

The inlet side of the intake manifold 3 is coupled to an air cleaner (not shown) via a collector 25 of an EGR device 24 (exhaust-gas recirculation device) which will be described later. Fresh air (outside air) suctioned by the air cleaner is subjected to dust removal and purification in the air cleaner, then fed to the intake manifold 3 through the collector 25, and then supplied to the respective cylinders of the engine 1. In the embodiment, the collector 25 of the EGR device 24 is coupled to the right side of the intake manifold 3 which is formed integrally with the cylinder head 2 to form the right surface of the cylinder head 2. That is, an outlet opening of the collector 25 of the EGR device 24 is coupled to an inlet opening of the intake manifold 3 provided on the right surface of the cylinder head 2. In this embodiment, the collector 25 of the EGR device 24 is coupled to the air cleaner via an intercooler (not shown) and the two-stage turbocharger 30, as will be described later.

The EGR device 24 includes: the collector 25 serving as a relay pipe passage that mixes a recirculation exhaust gas of the engine 1 (an EGR gas from the exhaust manifold 4) with fresh air (outside air from the air cleaner), and supplies a mixed gas to the intake manifold 3; an intake throttle member 26 that communicates the collector 25 with the air cleaner; a recirculation exhaust gas tube 28 that constitutes a part of a recirculation flow pipe passage connected to the exhaust manifold 4 via an EGR cooler 27; and an EGR valve member 29 that communicates the collector 25 with the recirculation exhaust gas tube 28.

The EGR device 24 is disposed on the right lateral side of the intake manifold 3 in the cylinder head 2. The EGR device 24 is fixed to the right surface of the cylinder head 2, and is in communication with the intake manifold 3 in the cylinder head 2. In the EGR device 24, the collector 25 is coupled to the intake manifold 3 on the right surface of the cylinder head 2, and an EGR gas inlet of the recirculation exhaust gas tube 28 is coupled and fixed to a front portion of the intake manifold 3 on the right surface of the cylinder head 2. The EGR valve member 29 and the intake throttle member 26 are coupled to the front and rear of the collector 25, respectively. An EGR gas outlet of the recirculation exhaust gas tube 28 is coupled to the rear end of the EGR valve member 29.

The EGR cooler 27 is fixed to the front surface of the cylinder head 2. The coolant and the EGR gas flowing in the cylinder head 2 flows into and out of the EGR cooler 27. In the EGR cooler 27, the EGR gas is cooled. EGR cooler coupling bases 33, 34 for coupling the EGR cooler 27 to the front surface of the cylinder head 2 protrude from left and right portions of the front surface of the cylinder head 2. The EGR cooler 27 is coupled to the coupling bases 33, 34. That is, the EGR cooler 27 is disposed on the front side of the cylinder head 2 and at a position above the flywheel housing 7 such that a rear end surface of the EGR cooler 27 and the front surface of the cylinder head 2 are spaced from each other.

The two-stage turbocharger 30 is disposed on a lateral side (in the embodiment, the left lateral side) of the exhaust manifold 4. The two-stage turbocharger 30 includes a high-pressure turbocharger 51 and a low-pressure turbocharger 52. The high-pressure turbocharger 51 includes a high-pressure turbine 53 in which a turbine wheel (not shown) is provided and a high-pressure compressor 54 in which a blower wheel (not shown) is provided. The low-pressure turbocharger 52 includes a low-pressure turbine 55 in which a turbine wheel (not shown) is provided and a low-pressure compressor 56 in which a blower wheel (not shown) is provided.

An exhaust gas inlet 57 of the high-pressure turbine 53 is coupled to the exhaust manifold 4. An exhaust gas inlet 60 of the low-pressure turbine 55 is coupled to an exhaust gas outlet 58 of the high-pressure turbine 53 via a high-pressure exhaust gas tube 59. An exhaust gas introduction side end portion of an exhaust gas discharge pipe (not shown) is coupled to an exhaust gas outlet 61 of the low-pressure turbine 55. A fresh air supply side (fresh air outlet side) of the air cleaner (not shown) is connected to a fresh air inlet port (fresh air inlet) 63 of the low-pressure compressor 56 via an air supply pipe 62. A fresh air inlet port 66 of the high-pressure compressor 54 is coupled to a fresh air supply port (fresh air outlet) 64 of the low-pressure compressor 56 via a low-pressure fresh air passage pipe 65. A fresh air introduction side of the intercooler (not shown) is connected to a fresh air supply port 67 of the high-pressure compressor 54 via a high-pressure fresh air passage pipe (not shown).

The exhaust gas inlet 57 of the high-pressure turbine 53 is coupled to the exhaust manifold 4, and the high-pressure turbocharger 51 is fixed to the left lateral side of the exhaust manifold 4. On the other hand, the low-pressure turbocharger 52 is coupled to the high-pressure turbocharger 51 via the high-pressure exhaust gas tube 59 and the low-pressure fresh air passage pipe 65, and is fixed above the exhaust manifold 4. Thus, the exhaust manifold 4 and the high-pressure turbocharger 51 with a small diameter are disposed side-by-side with respect to the left-right direction below the low-pressure turbocharger 52 with a large diameter. As a result, the two-stage turbocharger 30 is arranged so as to surround the left surface and the upper surface of the exhaust manifold 4. That is, the exhaust manifold 4 and the two-stage turbocharger 30 are arranged so as to form a rectangular shape in a rear view (or front view), and are compactly fixed to the left surface of the cylinder head 2.

Next, referring to FIG. 9 to FIG. 16, a configuration of the cylinder block 6 and a valve gear structure will be described. The cylinder block 6 is provided with a crank case 71 accommodating the crankshaft 5, and cylinder bores 73 for four valves respectively accommodating pistons 72. Each piston 72 is connected to the crankshaft 5 through a connecting rod 74, and is disposed so as to be vertically slidable within the cylinder bore 73.

Further, the cylinder block 6 includes a cam chamber 76 accommodating a camshaft 75, block-side push-rod chambers 78 (push-rod chambers) accommodating lower end sides of push-rods 77, and a tappet holder 80 holding tappets 79 in a slidable manner. Each of the tappets 79 is arranged between an intake cam 75*a* or an exhaust cam 75*b* of the camshaft 75 and corresponding one of push-rods 77, and transmits a drive force of the camshaft 75 to the push-rod 77.

The cam chamber 76 extends in a longitudinal direction (front-rear direction) of the engine 1, when viewed from the left side of the cylinder bore 73. The cam chamber 76 communicates with the crank case 71. The camshaft 75 has a set of the intake cam 75*a* and the exhaust cam 75*b* for each cylinder. In this embodiment, there are four sets of intake and exhaust cams 75*b*. The camshaft 75 has a cam journal 75*c* between the sets of the intake and exhaust cams 75*a*, 75*b*. Each cam journal 75*c* is pivotally supported by a bearing 76*a* of the cam chamber 76. With the bearing 76*a* and the cam journal 75*c*, the cam chamber 76 is partitioned into a plurality of cam chamber segments 81 for each of the sets of the intake and exhaust cams 75*a*, 75*b*. In this embodiment, the cam chamber 76 is partitioned into four cam chamber segments 81.

Figure 16:
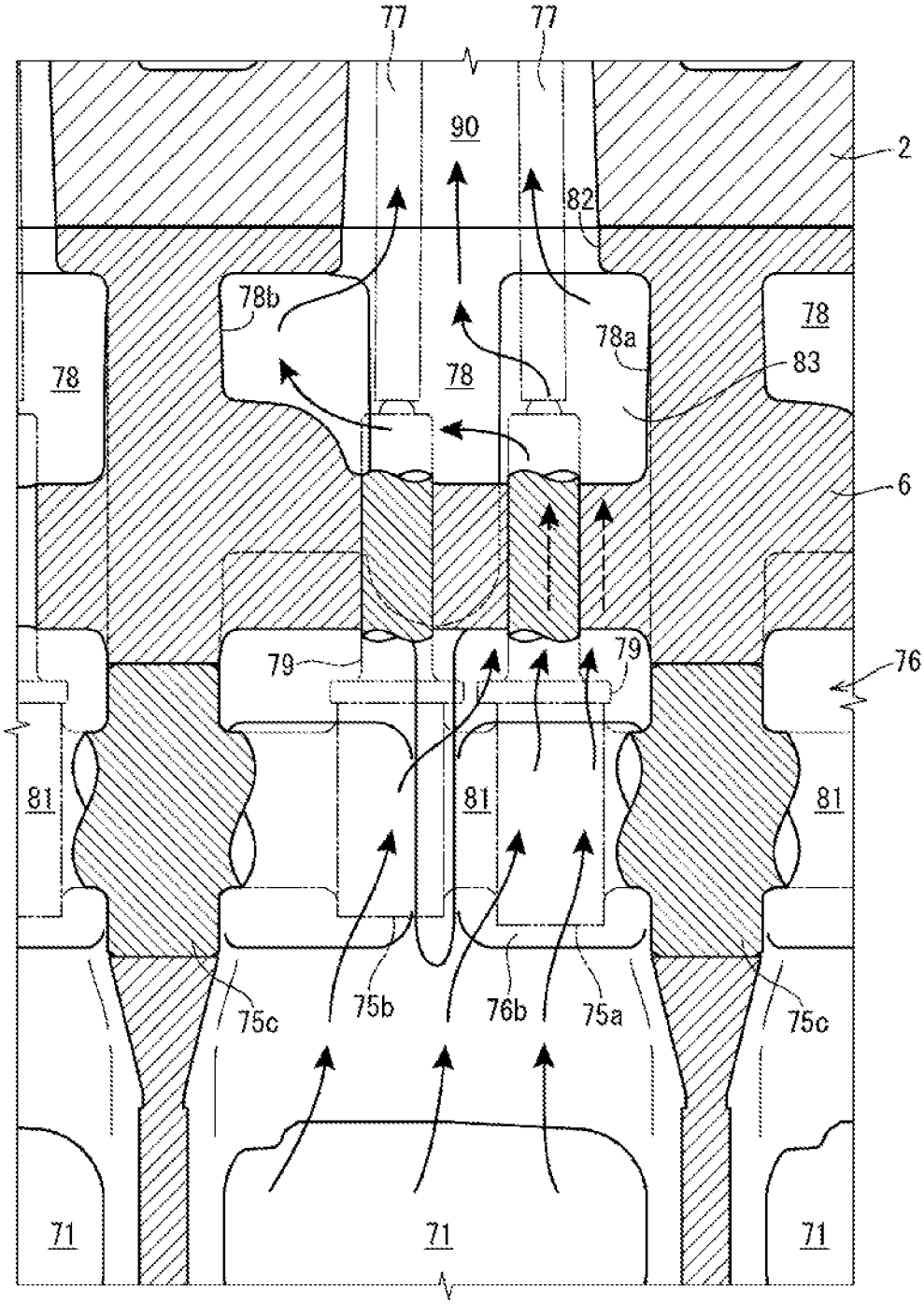
FIG. 16 A schematic cross-sectional view of the periphery of the bypass passage of FIG. 12 enlarged.

The block-side push-rod chamber 78 is arranged above the cam chamber 76, and is partitioned for each cylinder. In this embodiment, there are four block-side push-rod chambers 78 aligned in the longitudinal direction (front-rear direction) of the engine 1. As shown in FIG. 13(A), a communication hole 82 is formed in each of the block-side push-rod chamber 78, in a coupling surface of the cylinder block 6 with the cylinder head 2. In this embodiment, the size of each block-side push-rod chamber 78 is larger than the size of the communication hole 82, relative to the axial direction along the rotational axis of the camshaft 75. As shown in FIG. 13(A) and FIG. 16, a rear inner wall 78*a* and a front inner wall 78*b*, which are inner walls on one side and another side of the block-side push-rod chamber 78 intersecting the axial direction, respectively, are recessed towards outer side of the communication hole 82, in relation to the outline of the communication hole 82. In each block-side push-rod chamber 78 and each communication hole 82, two lower end sides of the push-rods 77 are inserted.

The tappet holder 80 is formed between the cam chamber 76 and the block-side push-rod chambers 78, and partitions the cam chamber 76 and the block-side push-rod chambers 78. Further, the cylinder block 6 has bypass passages 83 between the tappet holder 80 and the cylinder bores 73, each of which passages communicates the cam chamber 76 with corresponding one of the block-side push-rod chambers 78.

Figure 12:
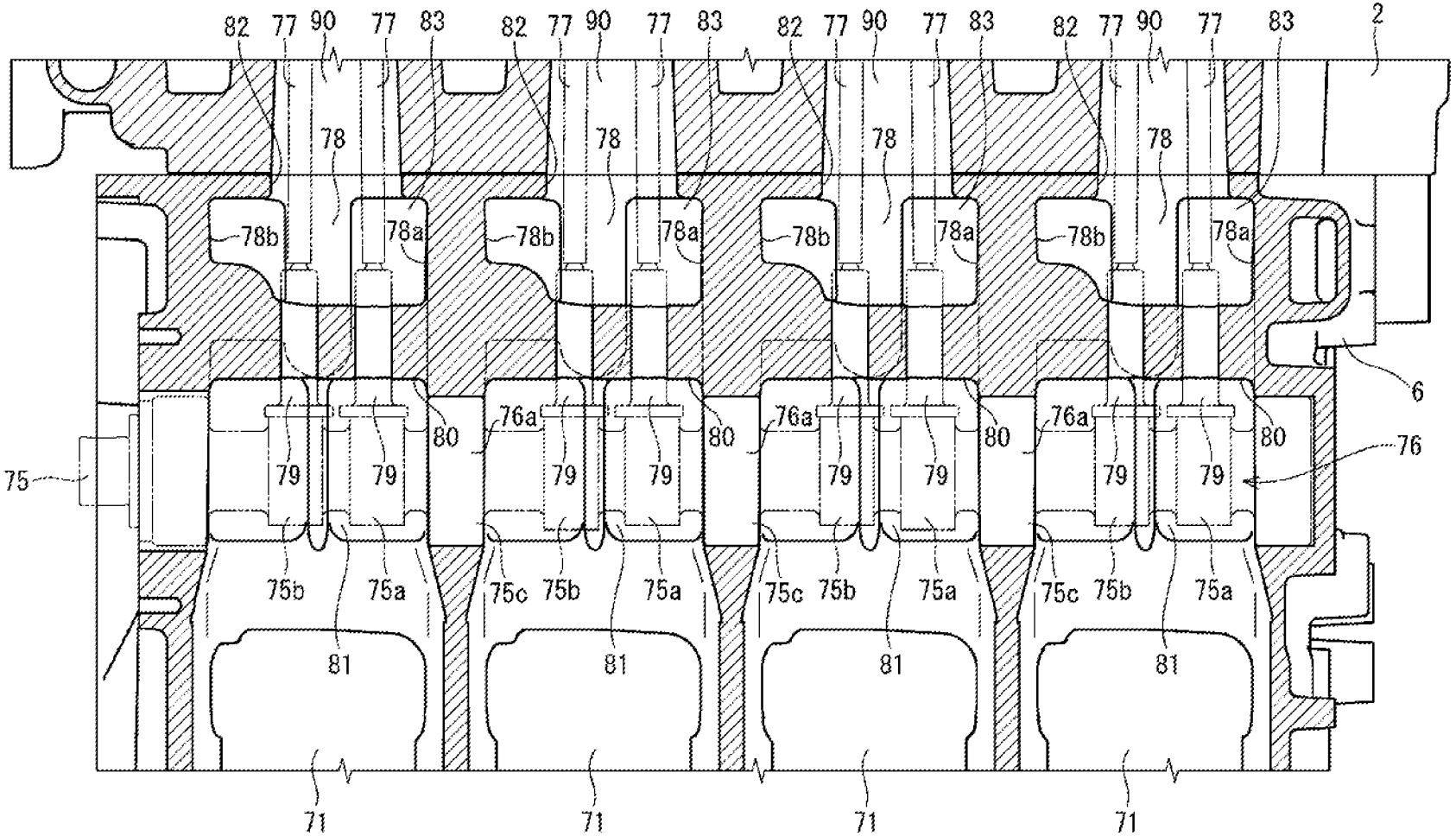
FIG. 12 A schematic cross-sectional view taken along the line 12-12 in FIG. 9.

As shown in FIG. 12 and FIG. 16, each bypass passage 83 is in communication with block-side the push-rod chamber 78 a at a position close to the rear inner wall 78*a* of the block-side push-rod chamber 78, relative to the axial direction of the rotational axis of the camshaft 75. Further, the bypass passage 83 is in communication with each of the cam chamber segments 81 at a position offset from the center of the cam chamber segment 81 in the axial direction of the rotational axis of the camshaft 75.

Figure 10:
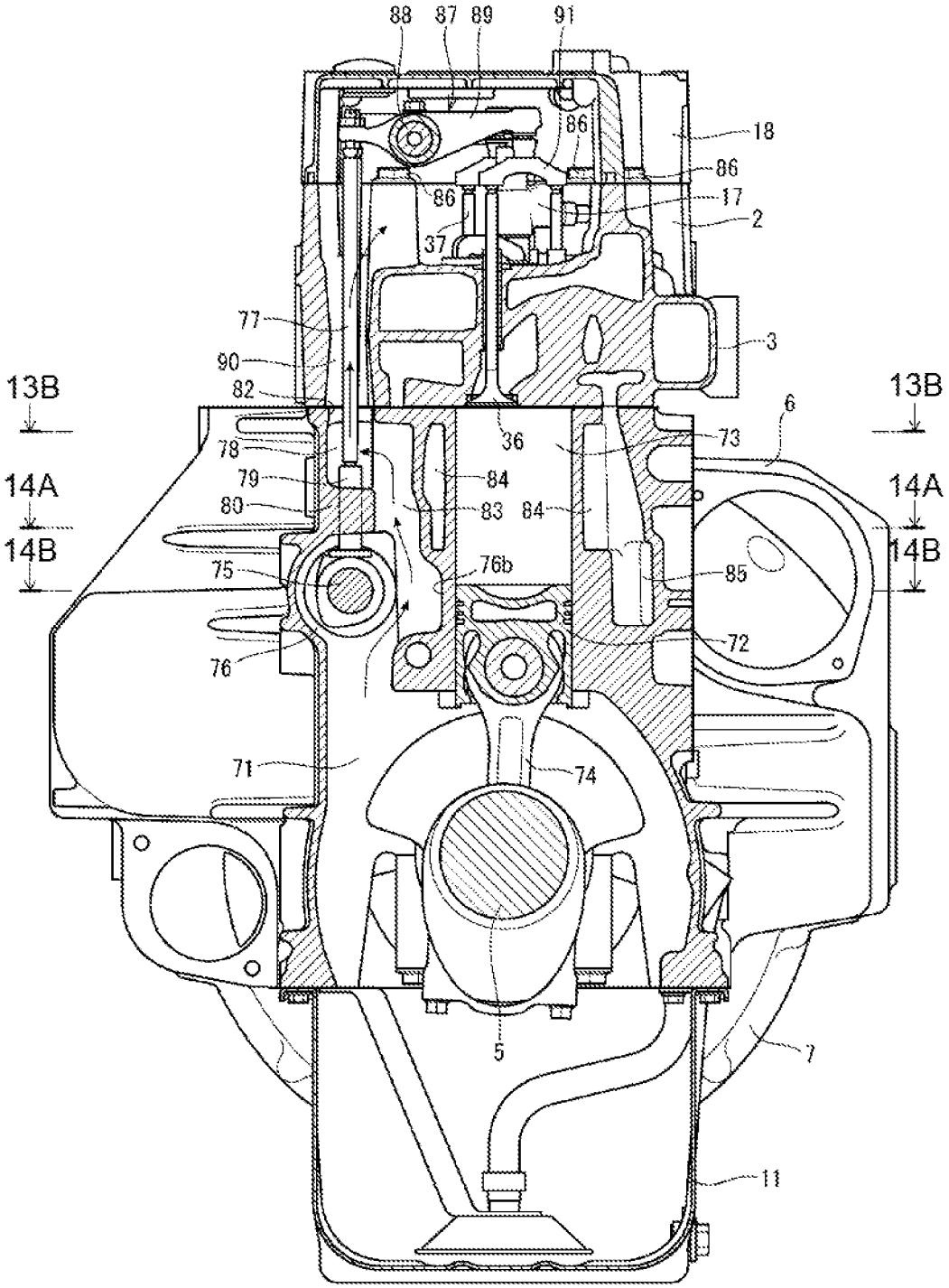
FIG. 10 A schematic cross-sectional view taken along the line 10-10 in FIG. 9.
Figure 15:
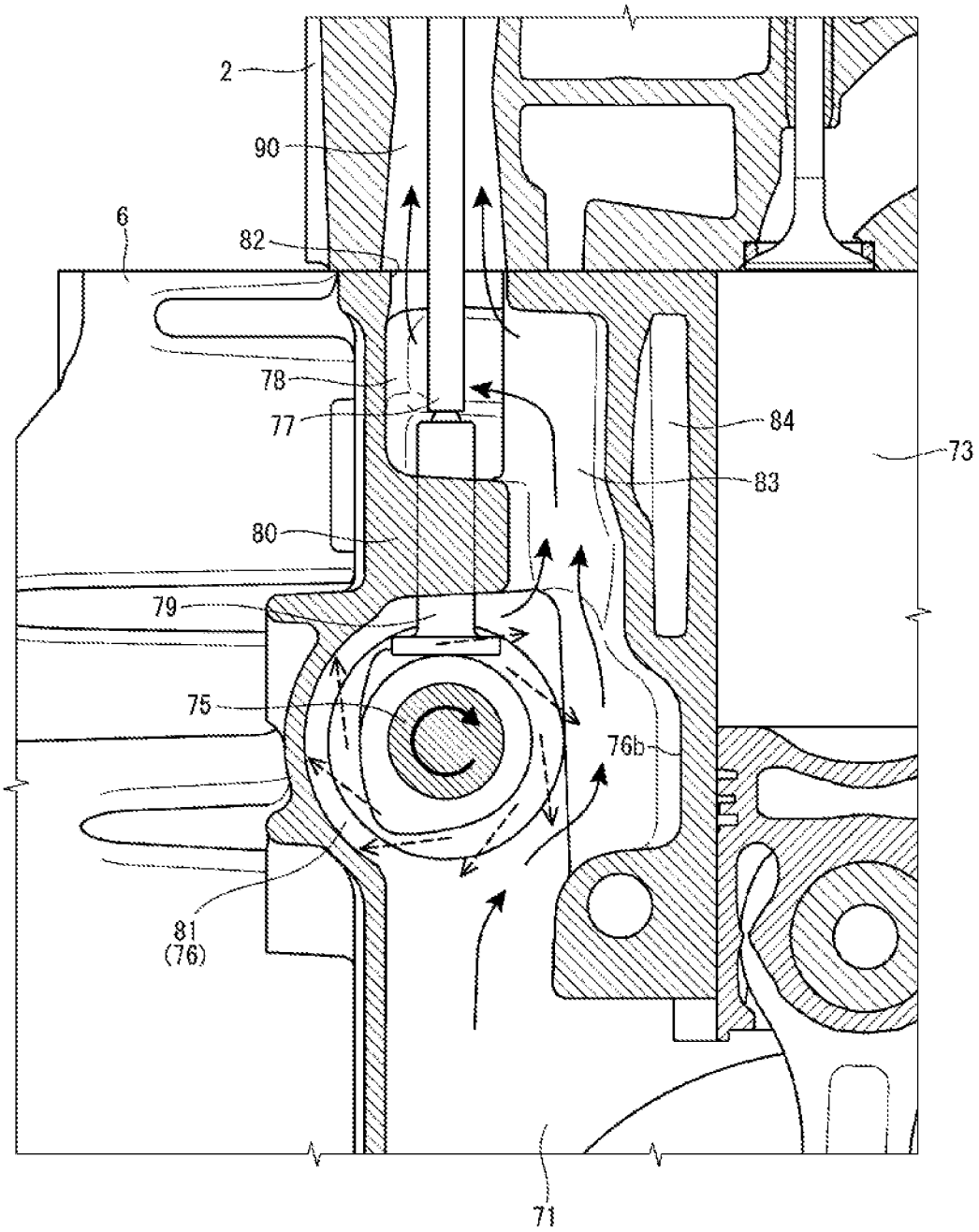
FIG. 15 A schematic cross-sectional view of the periphery of the bypass passage of FIG. 10 enlarged.

As shown in FIG. 10 and FIG. 15, at least a part of a cylinder bore side inner wall 76*b*, which is an inner wall on the side of the cylinder bore 73 of the cam chamber 76, in the lower portion of the bypass passage 83, is recessed closer to the cylinder bore 73 than the bypass passage 83. In this embodiment, a portion of the bore side inner wall 76*b* in a lower position of the bypass passage 83 is recessed towards the cylinder bore 73.

As shown in FIG. 15, the camshaft 75 is configured so that the outer circumferential surface of the camshaft 75 rotates in a direction from the side of the tappet holder 80 to the side of the crank case 71 (from the top to bottom), when viewed from the side of the cylinder bore 73. In this embodiment, the camshaft 75 rotates clockwise when viewed from the rear side of the engine 1.

Further, the cylinder block 6 includes a water jacket 84 arranged around the cylinder bores 73 and a water rail 85 extended in the longitudinal direction (front-rear direction), as shown in FIG. 10, and FIG. 13A through FIG. 14B. The water rail 85 is arranged on the right side of the cylinder bores 73, in a position lower than the water jacket 84. Further, as shown in FIG. 13A through FIG. 14B, the water rail 85 meanders roughly along corrugation formed by arrangement of the four cylinder bores 73 corresponding to four cylinders. The water rail 85 is provided at a position different from the axis of each head fastening bolts 86 for fixing the cylinder head 2 to the cylinder block 6 in a plan view.

Figure 9:
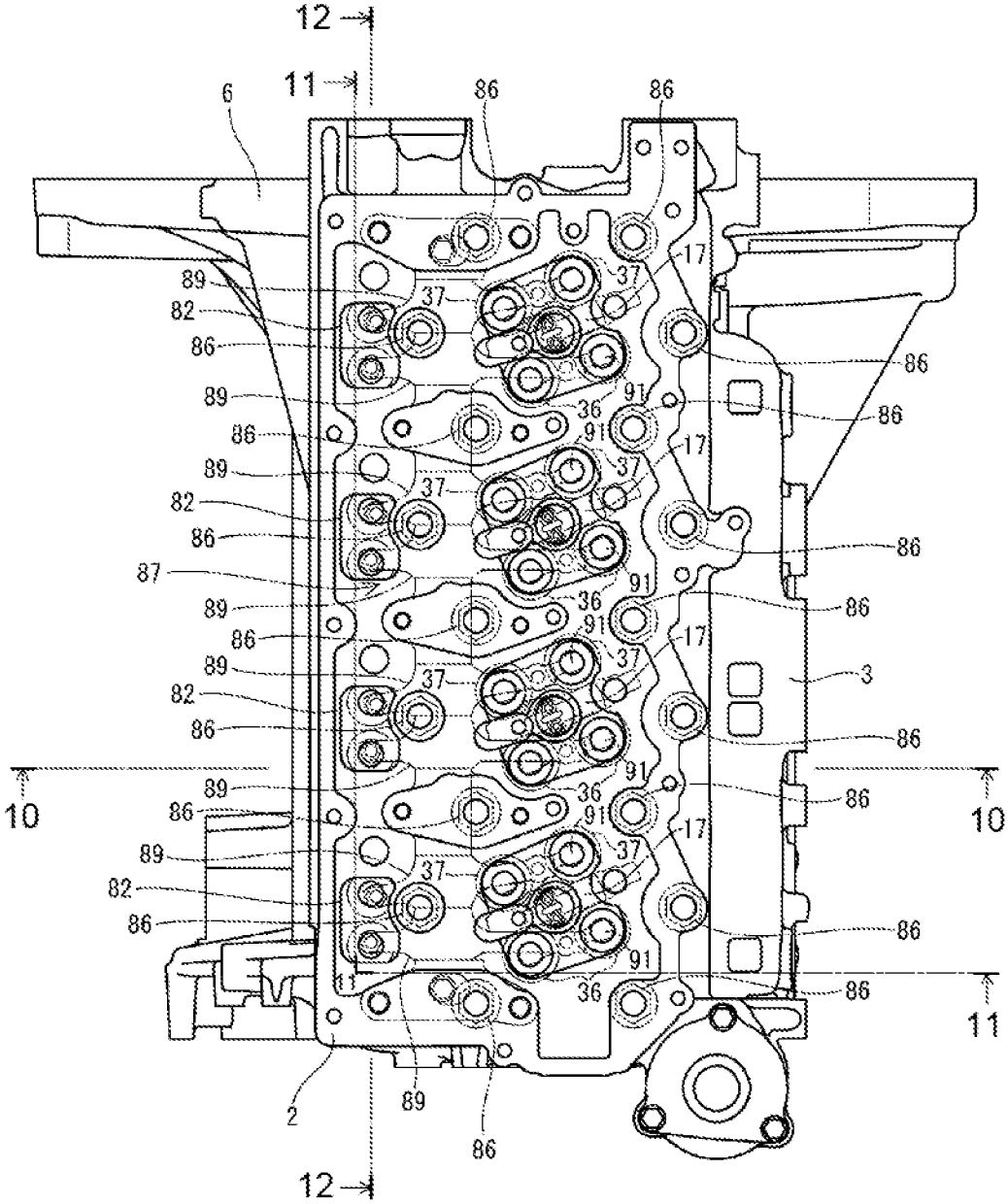
FIG. 9 A schematic plan view of a cylinder head and a cylinder block.
Figure 11:
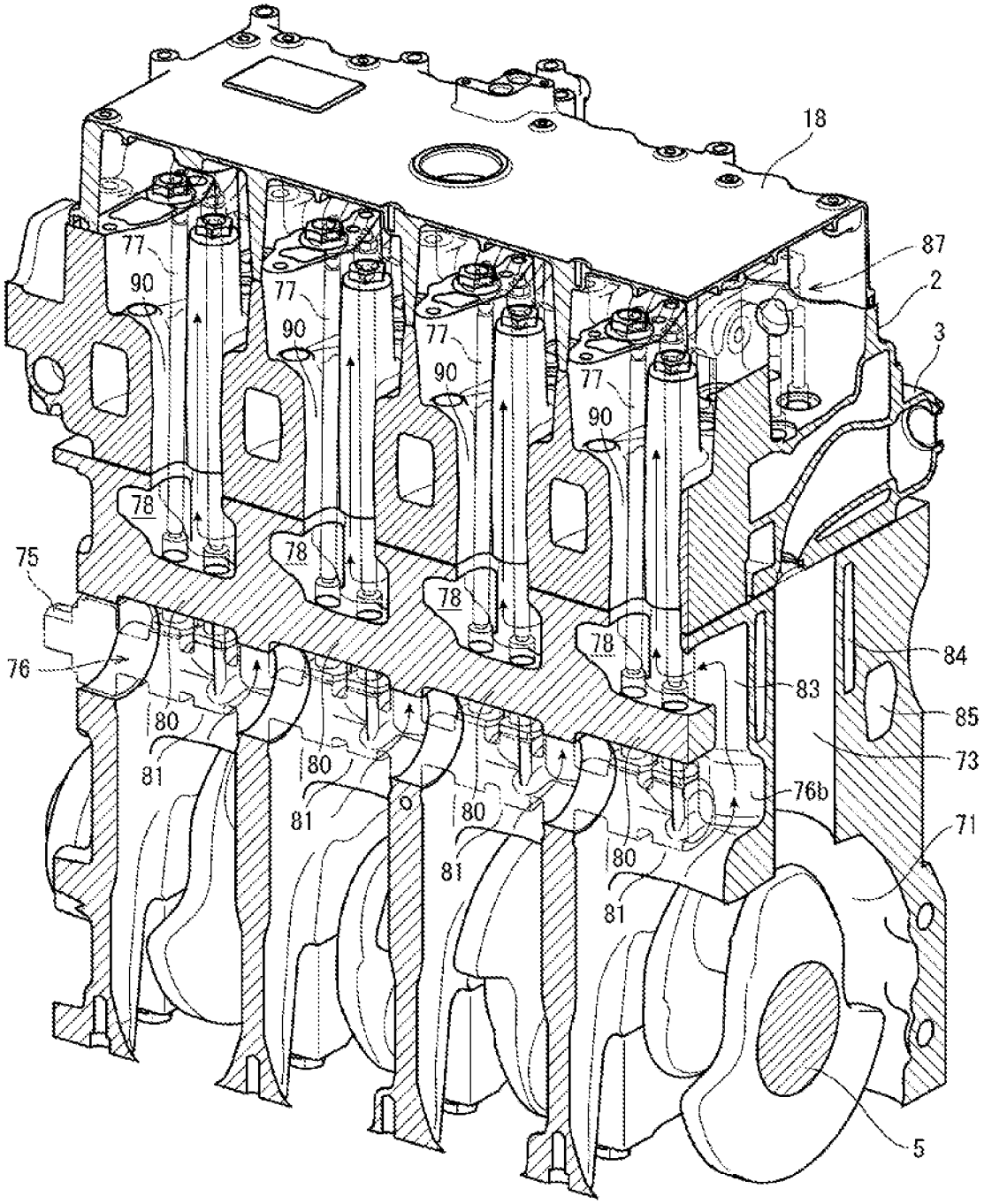
FIG. 11 A schematic cross-sectional perspective view taken along the line 11-11-11 in FIG. 9.

As shown in FIG. 9 to FIG. 11, the cylinder head 2 is arranged on the cylinder block 6. The cylinder head 2 is bolt-fastened to the cylinder block 6 by using head fastening bolts 86. The upper surface of the cylinder head 2 is covered with the head cover 18. The space inside the head cover 18 forms a valve arm chamber. In the head cover 18, a valve gear structure 87 associated with the camshaft 75 is arranged. Further, in the cylinder head 2, the intake valves 36 and the exhaust valves 37 are provided for each of the cylinders. The engine 1 of the present embodiment is of a four-valve type having two intake valves 36 and two exhaust valves 37 for each cylinder.

Further, the engine 1 is of an OHV type, and the valve gear structure 87 includes: the tappet 79 and the push-rod 77 which are moved up and down by the intake cam 75*a* and the exhaust cam 75*b* provided on the camshaft 75; and a valve arm 89 configured to rotate about a valve arm shaft 88 horizontally long in the front-rear direction in the head cover 18, with up and down movement of the push-rod 77. The upper end side of the push-rod 77 protrudes inside the head cover 18, through the head-side push-rod chamber 90 provided in the cylinder head 2. The upper end side of the push-rod 77 is connected to one end side of the valve arm 89. The other end side of the valve arm 89 is in contact with the two intake valves 36 or the two exhaust valves 37 through a valve bridge 91. Rotation of the camshaft 75 moves the push-rod 77 up and down, and rotates the valve arm 89 about the valve arm shaft 88, thereby opening and closing the intake valves 36 and the exhaust valves 37 of each cylinder.

As shown in FIG. 10, the crank case 71 is in communication with the head-side push-rod chamber 90 of the cylinder head 2 through the cam chamber 76, the bypass passage 83, and the block-side push-rod chamber 78. The blow-by gas in the crank case 71 moves to the side of the cylinder head 2, through the cam chamber 76, the bypass passage 83 and the block-side push-rod chamber 78. It should be noted that the head-side push-rod chamber 90, the block-side push-rod chamber 78, the bypass passage 83, and the cam chamber 76 also serve as an oil-trap path configured to return the lubricant in the head cover 18 to the side of the crank case 71.

As hereinabove described, in the engine 1 of the present embodiment, the tappet holder 80 partitions the cam chamber 76 and the block-side push-rod chambers 78. Further, the bypass passages 83 is formed between the tappet holder 80 and the cylinder bores 73, each of which passages communicates the cam chamber 76 with corresponding one of the block-side push-rod chambers 78. Thus, as shown in FIG. 10, FIG. 11, and FIG. 15, the cam chamber 76, the bypass passage 83, and the block-side push-rod chamber 78 form a blow-by gas path bent to bypass the tappet holder 80. The engine 1 induces adhesion of lubricant to the wall surface or bonding of droplets of lubricant in the mist-form by having the blow-by gas collide with a wall surface within the bent blow-by gas path. Therefore, a captured amount of lubricant in the blow-by gas can be increased, and the amount of lubricant flowing out from the crank case 71 to the side of the cylinder head 2 through the cam chamber 76, the bypass passage 83, and the block-side push-rod chamber 78 can be reduced.

Further, as shown in FIG. 10, FIG. 11, and FIG. 15, the engine 1 of the present embodiment is such that at least a part of a bore side inner wall 76*b* (cylinder bore side inner wall) of the cam chamber 76, in the lower portion of the bypass passage 83, is recessed closer to the cylinder bore 73 than the bypass passage 83. With the recessed portion of the bore side inner wall 76*b*, the engine 1 of the present embodiment can avoid the lubricant captured in the block-side push-rod chamber 78 or the bypass passage 83 from being taken out again by the blow-by gas, when the captured lubricant flows on an inner wall surface of the bypass passage 83 down to the bore side inner wall 76*b* of the cam chamber 76. Therefore, the amount of lubricant flowing out to the side of the cylinder head 2 can be further reduced. Although the portion of the bore side inner wall 76*b* in a lower position of the bypass passage 83 is recessed towards the cylinder bore 73 in the present embodiment, the portion of the bore side inner wall 76*b* recessed towards the side of the cylinder bore 73 is not particularly limited. For example, an upper portion of or the entire bore side inner wall 76*b* may be recessed closer to the cylinder bore 73 than the bypass passage 83.

Further, as shown in FIG. 15, the camshaft 75 is configured so that the outer circumferential surface of the camshaft 75 rotates in a direction from the side of the tappet holder 80 to the side of the crank case 71 (from the top to bottom), when viewed from the side of the cylinder bore 73. Therefore, the splashes of the lubricant scattered from the camshaft 75 surface due to the rotation of the camshaft 75 hardly enter the bypass passage 83 and do not flow toward the side of the cylinder head 2 in the bypass passage 83, as indicated by broken line in FIG. 15. Therefore, the engine 1 can keep the splashes of the lubricant from moving towards the side of the cylinder head 2, and further reduce the amount of the lubricant flowing out to the side of the cylinder head 2. The rotation direction of the camshaft 75 is not limited to the embodiment, and may be the opposite direction.

Figure 13B:
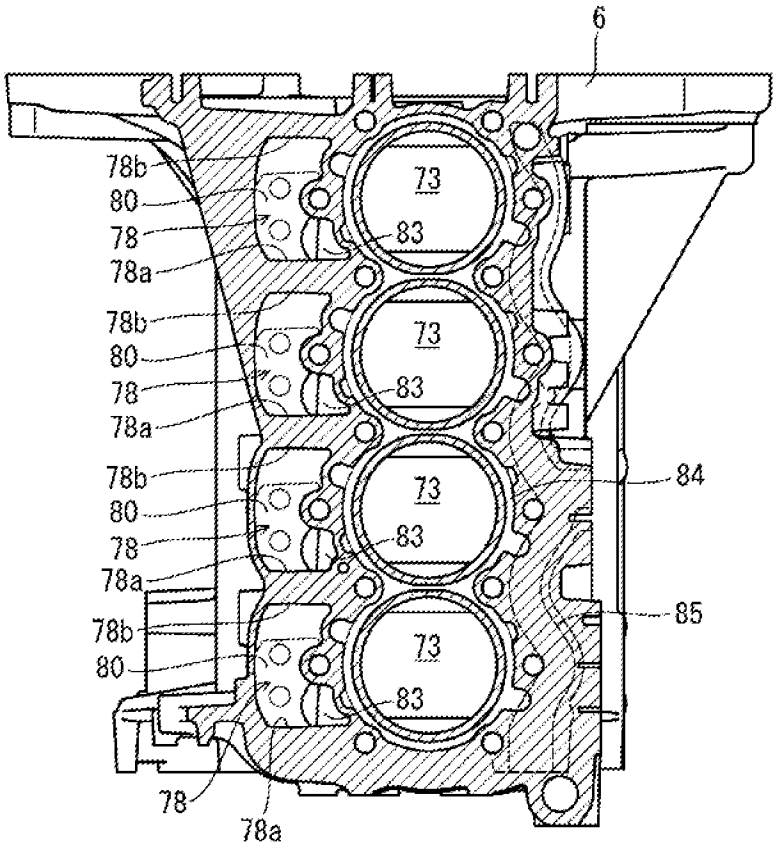
Figure 13A:
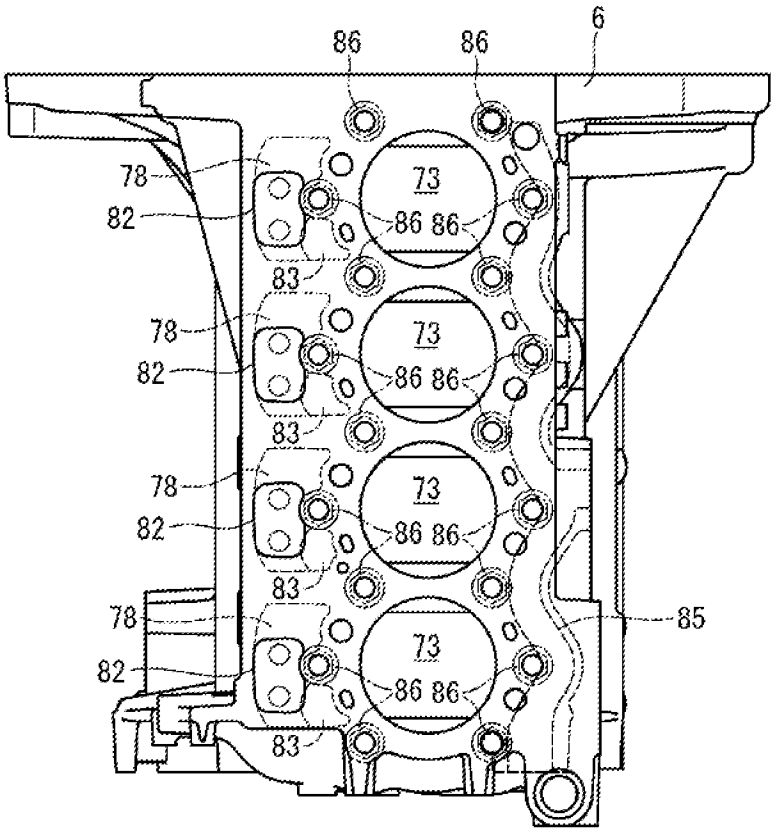
Figure 14B:
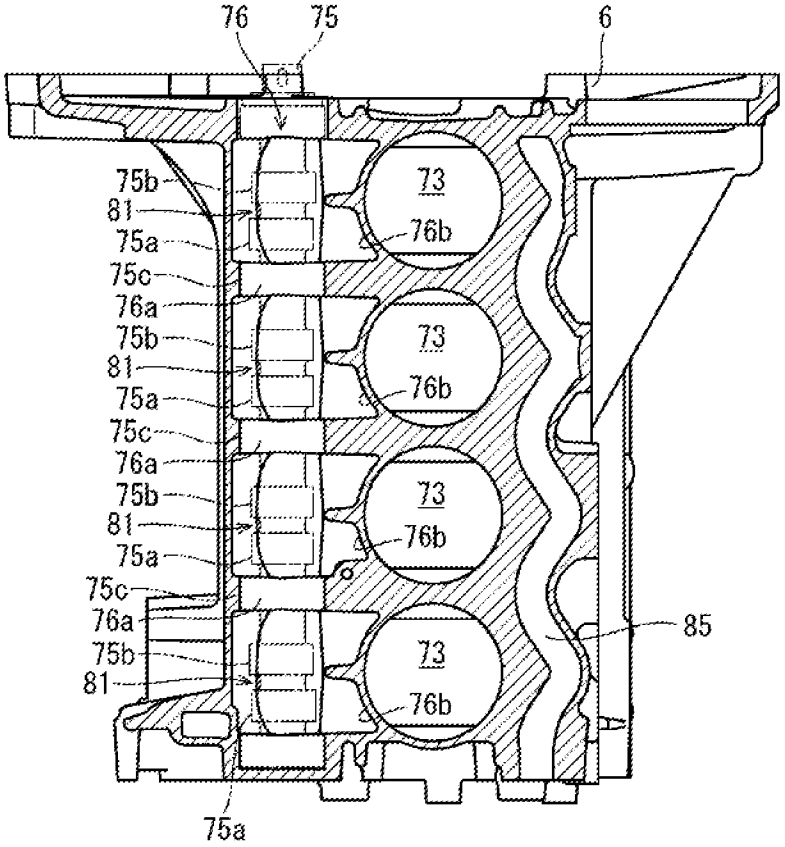
Figure 14A:
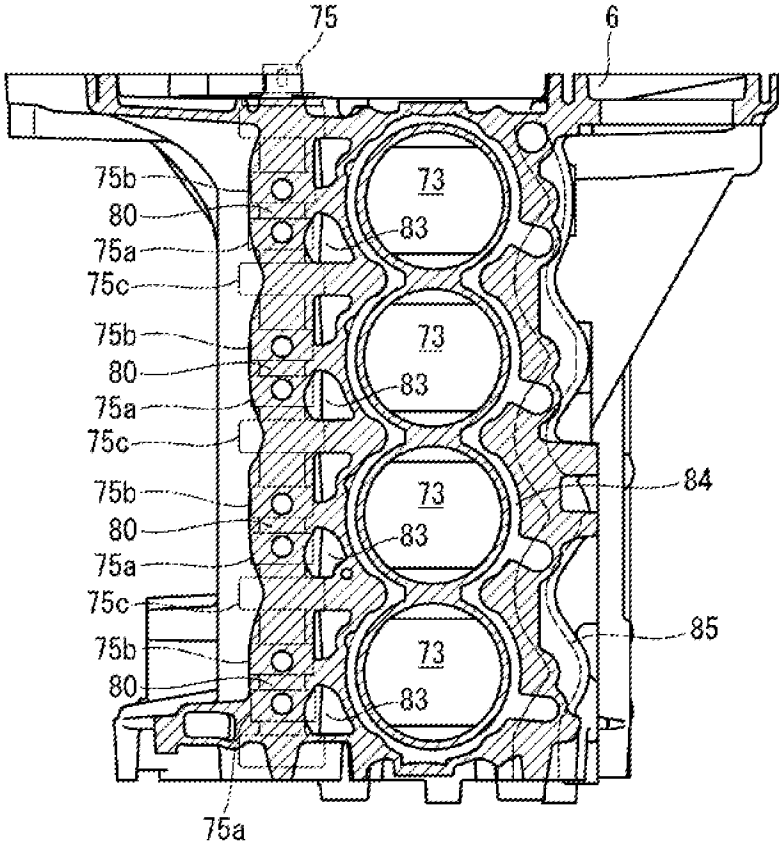

Further, as shown in FIG. 12, FIG. 13B, and FIG. 16, the engine 1 of the present embodiment is such that the bypass passage 83 is in communication with the block-side push-rod chamber 78 at a position close to the rear inner wall 78*a* out of the front and rear inner walls of the block-side push-rod chamber 78, the inner walls intersecting an axial direction along a rotational axis of the camshaft 75, This makes the blow-by gas path more complicated, and forms a flow of the blow-by gas in a lateral direction within the block-side push-rod chamber 78, and increases an amount of the blow-by gas colliding with the wall surface within the blow-by gas path. Therefore, the engine 1 can further reduce the amount of lubricant flowing out to the side of the cylinder head 2. The position at which the bypass passage 83 is in communication with the block-side push-rod chamber 78 is not limited to the embodiment. For example, the position may be close to the front inner wall 78*b*, or in a middle position of the block-side push-rod chamber 78.

Further, the engine 1 is such that the front inner wall 78*b* (another inner wall) out of the inner walls of the block-side push-rod chamber 78 is recessed towards outside of an outline of a communication hole 82 provided in a joint surface of the cylinder block 6 with the cylinder head 2. This makes the blow-by gas path complicated as shown in FIG. 16, and a part of the flow of the blow-by gas in the block-side push-rod chamber 78 can flow nearby the front inner wall 78*b* (a portion recessed towards outside of the communication hole 82). Therefore, the amount of the lubricant flowing out to the side of the cylinder head 2 can be further reduced. The shape of the inner walls of the block-side push-rod chamber 78 with respect to the 256 communication hole 82 is not limited to the present embodiment, and various modifications are possible.

Further, as shown in FIG. 11, FIG. 12, FIG. 14A, FIG. 14B, and FIG. 16, the engine 1 of the present embodiment is such that the camshaft 75 includes a plurality of sets of the intake and exhaust cams 75*a*, 75*b*, the cam chamber 76 is partitioned into a plurality of cam chamber segments 81 for each set of the intake and exhaust cams 75*a*, 75*b*, and the bypass passage 83 is in communication with each of the cam chamber segments 81 at a position offset rearward from the center of the cam chamber segment 81 in the axial direction of the rotational axis of the camshaft 75. This way, the flow of the blow-by gas in each cam chamber segment 81 can be biased so as to let the blow-by gas collide with an inner wall of the cam chamber segment 81. Therefore, an amount of lubricant captured from the blow-by gas in the cam chamber segment 81 can be increased and the amount, of lubricant flowing out to the side of the cylinder head 2 can be further reduced. The position at which the bypass passage 83 is in communication with the cam chamber segment 81 is not limited to the embodiment. For example, the position may be close to the front of the cam chamber segment 81, or in a middle position of the cam chamber segment 81.

While an embodiment of the present invention is described with reference to attached drawings, the configurations of respective parts of the present invention are not limited to those of the illustrated embodiment, but can be variously changed without departing from the gist of the invention.

REFERENCE SIGNS LIST

1 engine
2 cylinder head
5 crankshaft
6 cylinder block
71 crank case
73 cylinder bore
75 camshaft
75*a* intake cam
75*b* exhaust cam
76 cam chamber
76*a* bore side inner wall (inner wall on the side of cylinder bore)
77 push-rod
78 block-side push-rod chamber (push-rod chamber)
78*a* rear inner wall (one inner wall)
78*b* front inner wall (another inner wall)
79 tappet
80 tappet holder
81 cam chamber segment
82 communication hole
83 bypass passage

The invention claimed is:

1. An engine device comprising:

a cylinder block, a cylinder bore, a cam chamber accommodating a camshaft, a push-rod chamber accommodating a push-rod, and a tappet holder configured to hold a tappet in a slidable manner, the tappet being configured to transmit a drive force from the camshaft to the push-rod, wherein:

the tappet holder partitions the cam chamber and the push-rod chamber; and a bypass passage communicating the cam chamber with the push-rod chamber is formed between the tappet holder and the cylinder bore;

the bypass passage is in communication with the push-rod chamber at a first opening, the first opening defined by a first inner wall of multiple inner walls defining the push-rod chamber, the first opening positioned above the tappet holder and below a cylinder head; and a second inner wall of the multiple inner walls defining the push-rod chamber is opposite the first inner wall, the second inner wall and the first inner wall separated such that an opening of a communication hole in the push-rod chamber is positioned between the first inner wall and the second inner wall, the second inner wall is recessed laterally away from the opening in an axial direction of the camshaft, the communication hole defined by a joint surface of the cylinder block and the cylinder head.

2. The engine device according to claim 1, wherein:

at least a part of a cylinder bore side inner wall of the cam chamber, in a lower portion of the bypass passage, is positioned between the camshaft and the cylinder bore and recessed towards the cylinder bore; and the camshaft is configured so that an outer circumferential surface of the camshaft rotates in a direction from a tappet holder side of the camshaft, to a side of the camshaft corresponding to the cylinder bore side inner wall, to a crank case side of the camshaft, wherein the tappet holder side of the camshaft is opposite the crank case side of the camshaft.

3. The engine device according to claim 1, wherein:

the camshaft comprises a plurality of sets of an intake cam and an exhaust cam, the plurality of sets of the intake cam and the exhaust cam including a first set of a first intake cam and a first exhaust cam;

the cam chamber comprises a plurality of cam chamber segments, the plurality of cam chamber segments including a first cam chamber segment;

the bypass passage is in communication with the first set of the first intake cam and the first exhaust cam and the first cam chamber segment at a position offset from a center of the first cam chamber segment in the axial direction of the camshaft.

* * * * *